US010344352B2

(12) United States Patent
Battini

(10) Patent No.: US 10,344,352 B2
(45) Date of Patent: Jul. 9, 2019

(54) HEAT CHAMBER FURNACE FOR HEAT TREATMENT WITH GASEOUS ATMOSPHERE QUENCHING

(71) Applicant: H.T. SOLUTIONS S.R.L., Vailate (CR) (IT)

(72) Inventor: Maurizio Battini, Caravaggio (IT)

(73) Assignee: H.T. SOLUTIONS S.R.L., Vailate (CR) (IT)

( * ) Notice: Subject to any disclaimer, the term of this patent is extended or adjusted under 35 U.S.C. 154(b) by 367 days.

(21) Appl. No.: 15/121,057

(22) PCT Filed: Nov. 28, 2014

(86) PCT No.: PCT/IB2014/066431
§ 371 (c)(1),
(2) Date: Aug. 24, 2016

(87) PCT Pub. No.: WO2015/128708
PCT Pub. Date: Sep. 3, 2015

(65) Prior Publication Data

US 2016/0362765 A1 Dec. 15, 2016

(30) Foreign Application Priority Data

Feb. 27, 2014 (IT) ..... TO2014A0162

(51) Int. Cl.
*C21D 11/00* (2006.01)
*C21D 9/00* (2006.01)
(Continued)

(52) U.S. Cl.
CPC ..... *C21D 11/005* (2013.01); *C21D 1/613* (2013.01); *C21D 9/0043* (2013.01);
(Continued)

(58) Field of Classification Search
CPC ..... C21D 11/005; C21D 9/0062; C21D 1/613
See application file for complete search history.

(56) References Cited

U.S. PATENT DOCUMENTS

2004/0007565 A1 1/2004 Moller
2014/0042678 A1 2/2014 Wilson et al.
2016/0362765 A1* 12/2016 Battini ..... C21D 9/0043

FOREIGN PATENT DOCUMENTS

WO 2011056960 A1 5/2011

OTHER PUBLICATIONS

International Search Report and Written Opinion for International Application No. PCT/IB2014/066431(dated Apr. 16, 2015) (8 Pages).

* cited by examiner

*Primary Examiner* — Scott R Kastler
(74) *Attorney, Agent, or Firm* — Lucas & Mercanti, LLP

(57) ABSTRACT

A furnace for thermal treatment with gaseous atmosphere quenching having a bell inside which there are provided a rotor regulating the gas atmosphere flow, a heat exchanger regulating the temperature of the gas atmosphere and a thermal chamber configured for thermal treatment and the following gaseous atmosphere quenching. The thermal chamber has at least a surface positioned on a side adjacent to the heat exchanger and at least a surface positioned on an opposed side to the adjacent one to the heat exchanger and wherein at least a surface has a plurality of screens which connect the inside of the thermal chamber with the inside of the bell to allow the passage of the gas atmosphere from the thermal chamber to the bell, wherein the screens are adjustable to modify the passage section and so the flow of the gas atmosphere in function of the temperature required by the thermal treatment.

5 Claims, 8 Drawing Sheets

(51) Int. Cl.

| | |
|---|---|
| ***F27B 5/16*** | (2006.01) |
| ***C21D 1/613*** | (2006.01) |
| *C21D 1/773* | (2006.01) |
| *F27B 5/06* | (2006.01) |

(52) U.S. Cl.
CPC ..... *C21D 9/0062* (2013.01); *F27B 5/16* (2013.01); *C21D 1/773* (2013.01); *F27B 2005/062* (2013.01); *F27B 2005/163* (2013.01)

HEAT CHAMBER FURNACE FOR HEAT TREATMENT WITH GASEOUS ATMOSPHERE QUENCHING

CROSS-REFERENCE TO RELATED APPLICATIONS

This application is a 371 of PCT/M2014/066431, filed Nov. 28, 2014 which claims the benefit of Italian Patent Application No. TO2014A000162 filed Feb. 27, 2014.

DESCRIPTION

The present invention relates to an innovative thermal chamber for furnaces for thermal treatment with gaseous atmosphere quenching and a method for controlling said thermal chamber opening which allows the cooling speed of the same chamber to be controlled optimally.

As it is known at the state of the art, for thermal treatment it is intended a thermal heating cycle carried out in predetermined conditions and temperatures followed by more or less slow cooling, with the aim of making a metal or metal alloy acquire the crystalline structures, which give it determined mechanical and/or technological features.

In order to understand the thermal treatment effect on the structure of a metal alloy, it is needed to know the state diagram of the same alloy. However, such knowledge is not sufficient, in fact the state diagrams define the balance structures of a metal or an alloy at a determined temperature. The relative curves are therefore obtained by applying very slow heating and cooling (such that it is allowed to reach the balance at each temperature).

For this reason, an important role is carried out by the cooling or heating speed of the transformation. Such speed not only affects the transition temperatures (which generally are different from the ones obtained by the state diagrams), but also the same nature of the structure obtained, with the possibility to obtain metastable constituents (such for example the martensite in steels) absent in the state diagrams.

Generally, the thermal treatments of metals occur inside specific furnaces for example in furnaces with gaseous atmosphere quenching. Said furnaces comprise a thermal chamber where it is positioned the charge of the material to be treated. Such chamber, normally insulated, is provided with some apertures, also known as "screens" which connect the inner of the chamber with the inner of the outer bell, which insulates the furnace from the outer environment. Said apertures or screens are closed during the heating step in order to reduce heat dispersions to a minimum and to carry out the treatment with the maximum accuracy and to obtain uniformity of temperature inside the thermal chamber.

As it is known, the furnaces for traditional thermal treatment are provided with mono-block screens which during the cooling step are totally opened for allowing the cooling gas, input in the bell, to cross the thermal chamber and to absorb the heat of the charge. The gas passes then in a heat exchanger to be cooled and to be re-input in circulation by a rotor. The gas is then circulated until the charge reaches the desired temperature in the desired time interval.

The traditional solution is provided with a mono-block aperture or screen, positioned in the upper portion of the thermal chamber, upwards of the heat exchanger, which has the disadvantage that it can only carry out an opened-closed movement without any possibility of adjustment. In closing position, said screen adheres completely to the wall of the thermal chamber thus closing totally the passage of the gas. In opening position, it goes away from the wall of the chamber, thus creating a passage for the gas, but never uncovering completely the passage of the same gas.

Another disadvantage of the known system is given by the fact that the screen surface covers portion of the useful surface of the heat exchanger and therefore it worsens the efficiency of the thermal exchange.

Other solutions known for cooling thermal treatment furnaces use directional cooling systems controlled by suction means and means for directing the cooling gas. However, such solutions require a more complex thermal chamber configuration as well as a secondary channels system for directing gas, and are more expensive from the mounting point of view.

Therefore, there exists a need to provide furnaces for thermal treatment, which can have a continuous temperature adjustment in cooling step inside the thermal chamber, which is not provided with cooling systems of known type.

Anyway, at the state of the art there are not known systems which allow to control the temperature variation accurately and efficiently other than through a directed circulation of the gas in cooling step.

Aim of the present invention is a new system which is able to resolve the problems linked to the temperature adjustment in cooling step by means of the modulation of the screens or apertures of the thermal chamber together with the gas flow regulation.

Another aim of the present invention is to improve, by means of an accurate modulation of the screens, an increase in the output area of the gas from the thermal chamber and a consequent improvement of the flow rate and gas thermal exchange.

A first embodiment of the present invention is an furnace for thermal treatment with gaseous atmosphere quenching comprising a bell, a rotor actuated by a first motor, a heat exchanger and a thermal chamber, said thermal chamber comprising at least a surface positioned on a side adjacent to the heat exchanger and a surface positioned on an opposed side to the adjacent one to the heat exchanger and wherein at least a surface comprises a plurality of apertures or screens which connect the inside of the thermal chamber with the inside of the bell to allow the passage of the gas atmosphere from the thermal chamber to the bell and characterized in that said apertures are adjustable to modify the passage section of the gas atmosphere in function of the temperature required by the thermal treatment.

An advantage of such embodiment consists in the possibility to have more apertures on the surfaces of the thermal chamber, which allow a more efficient thermal exchange between the inside and the outside of the same thermal chamber.

According to another embodiment of the invention the apertures are hinged to the surfaces of the thermal chamber.

An advantage of such embodiment consists in the possibility to make them rotate comfortably and to obtain a closing and an opening regulated according to the treatment to be carried out.

According to another embodiment of the invention it is provided a actuation system which comprises a plurality of levers controlled by a rod connected to a crankshaft.

An advantage of such an embodiment consists in the simplicity and comfort of opening the apertures in synchronous.

According to another embodiment of the invention, said apertures have a movement in a range comprised between 0° and 90°, wherein 0° corresponds to the position in which the apertures are parallel to the wall of the thermal chamber, where the passage of the gas is completely closed; and wherein 90° corresponds to the position in which the apertures are perpendicular to the wall of the thermal chamber, where the passage of the gas is maximum.

An advantage of such embodiment consists in the possibility to choose a predetermined aperture angle so that the thermal exchange speed between the thermal chamber inside and outside can be varied.

Object of the present invention is further a method for controlling said screens or tongues opening and closing.

According to a preferred embodiment, the method controls the rotation angle of the screens openings: from the software interface provided in the operating panel (positioned in the machine or in the control switchboard) it is possible to set different set-points, i.e. parameters of the thermal cycle, among which:

the value of the opening angle of the screens, expressed in percent points (0 . . . 100% equal to 0 . . . 90 degrees).

or the cooling speed of the charge, which controls automatically the opening angle of the screens according to the temperature detected by the charge thermocouples.

Once the set point is set, the map of all the set-points or parameters defining the thermal cycle is transferred to the process controller of the system, the PLC, which sends, when suitable during the thermal cycle, a command to the inverter which regulates the rotation direction of the motor. Such motor, coupled to a worm screw, is provided with a bushing sliding on the same; integral to the bushing it is provided a rod which is constrained to the crankshaft and controls the whole lever system needed to carry out the screens rotation.

The position of the bushing is detected by an encoder, which transmits this datum to the controller (PLC) which verifies that the set cycle parameters (set-point) are respected: it compares the measured values with the set values and carries out the command, both of opening or closing of the screens, to bring back the system to the set value by actuating the inverter. By means of a feedback cycle it is obtained the convergence, i.e. the position of the bushing at the set point value provided on the map is obtained.

An advantage of such an embodiment consists in the possibility to carry out little temperature variations during the cooling step in well determined time intervals. The traditional solution provides screens which can carry out only a movement of the type opened-closed without any possibility of regulation. This implies that yet the opening of the screens causes a very high heat dispersion, i.e. the temperature can go down strongly in a short interval time in comparison with the values needed by the thermal treatments.

The solution provided allows an accurate regulation of the screens opening angle, thus allowing such a dissipation that the little temperature heads needed by the modern thermal treatments are respected.

In the following, there are described various embodiments of the invention by means of examples with reference to the appended drawings, in which.

Figure 1:
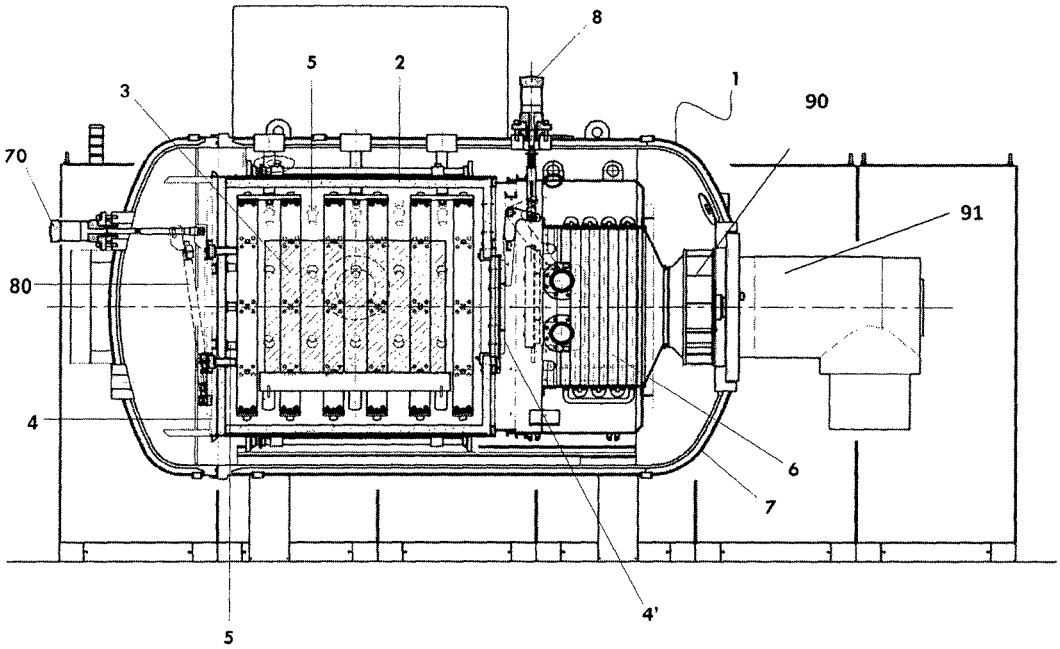
FIG. 1 shows a scheme of the basic structure of a furnace for thermal treatment with gaseous atmosphere quenching.

As it is shown in FIG. 1, a type of known furnace 1 for thermal treatment with gaseous atmosphere quenching comprises a thermal chamber 2 therein, where it is positioned the charge of material to be treated 3. Said thermal chamber 2 is insulated and is provided on each surface 4, 4' with a series of circular apertures 5 or screens 100 which connect the inside of thermal chamber 2 with the inside of the bell 7 in order to allow the passage of the gas atmosphere from the thermal chamber to the bell.

The screens 100, adjustable to modify the passage section of the gas atmosphere according to the temperature needed by the thermal treatment, and the circular apertures 5 are closed during the heating step in order to reduce the heat dispersions at minimum and to carry out the treatment with the maximum accuracy and to obtain temperature uniformity inside the thermal chamber 2. The furnace 1 comprises further a rotor 90, actuated by a motor 91 which has the function to circulate the gas homogeneously and according to predetermined speeds inside the bell 7.

In case of furnaces with circular thermal chambers 2, the apertures 100 can be usually positioned at least on the rear wall 4', while the front wall 4, as well as the whole circumference of the thermal chamber 2, is provided with a series of circular apertures 5 together with groups of covers 5' which close the same. The covers 5' positioned on the circumference are held together by a shaft 50, while those positioned on the front wall 4 are held together by a disk 80; both the solutions are intended to carry out the opening of the covers 5' in synchronous. A ring 60 positioned on the circumference of the thermal chamber 2, by rotating, controls the synchronous movement of all the shafts 50 and as a consequence of the covers 5' which uncover the circular apertures 5. At the same time, the disk 80 of the front wall 4, hinged to the same, is rotated by a pneumatic cylinder 70 thus uncovering all the circular openings 5 provided. At the same time, it is carried out the opening of the screens 100 of the rear wall 4'.

In case of furnaces 1 with thermal chambers 2 of square shape, the apertures 100 are positioned on at least a surface, going from the one adjacent to the heat exchanger; the other surfaces are provided with mono-block screens.

Figure 2:
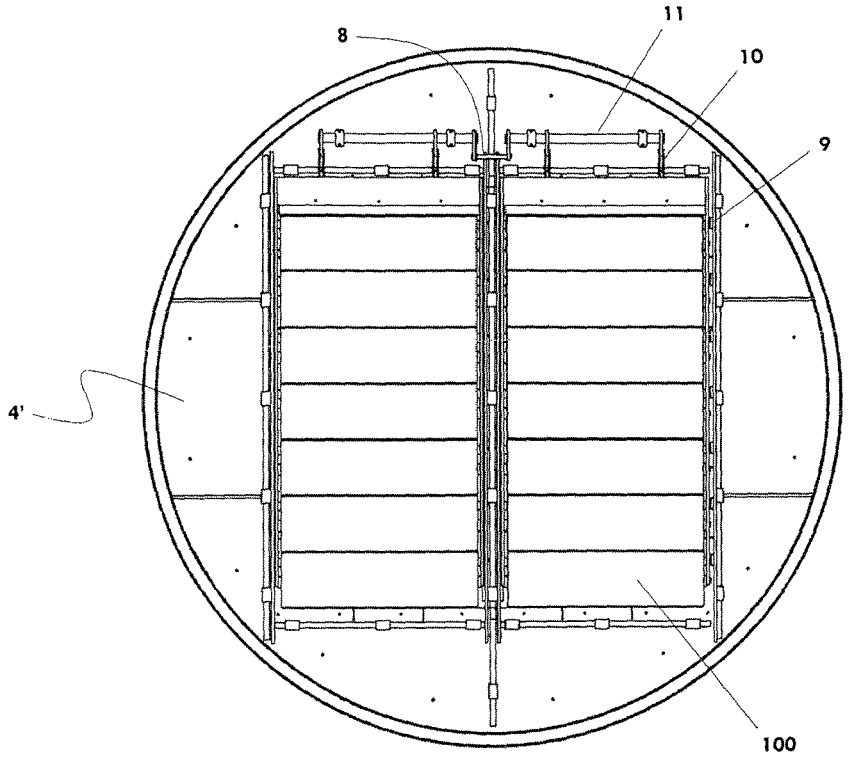
FIG. 2 shows a plant view of the rear surface of the thermal chamber, with screens in complete closing position, according to an embodiment of the present invention.
Figure 3:
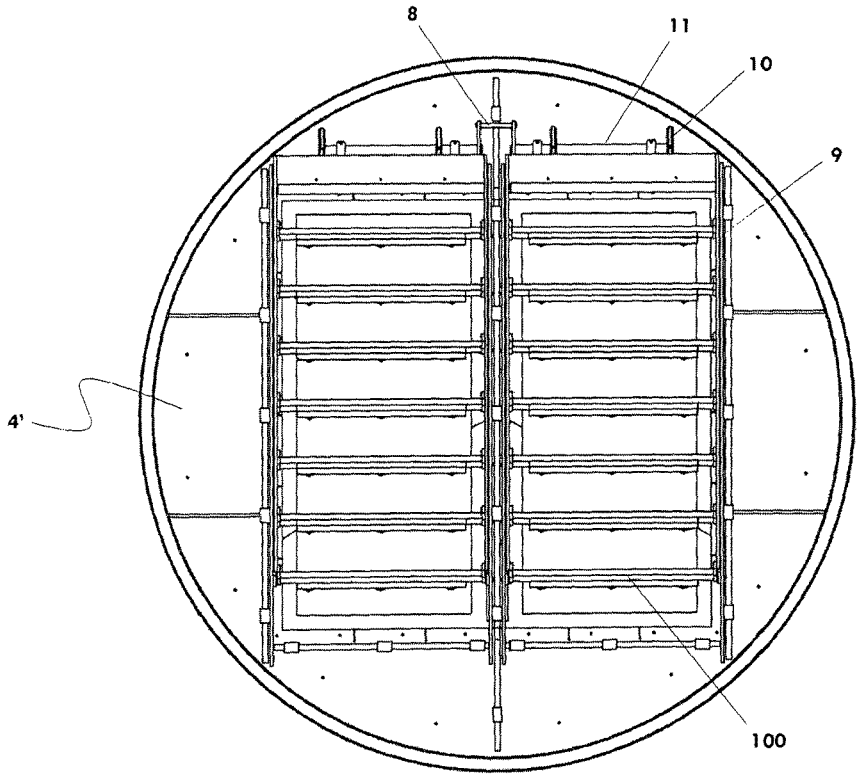
FIG. 3 shows a plant view of the rear surface of the thermal chamber, with screens in complete opening position, according to an embodiment of the present invention.
Figure 4:
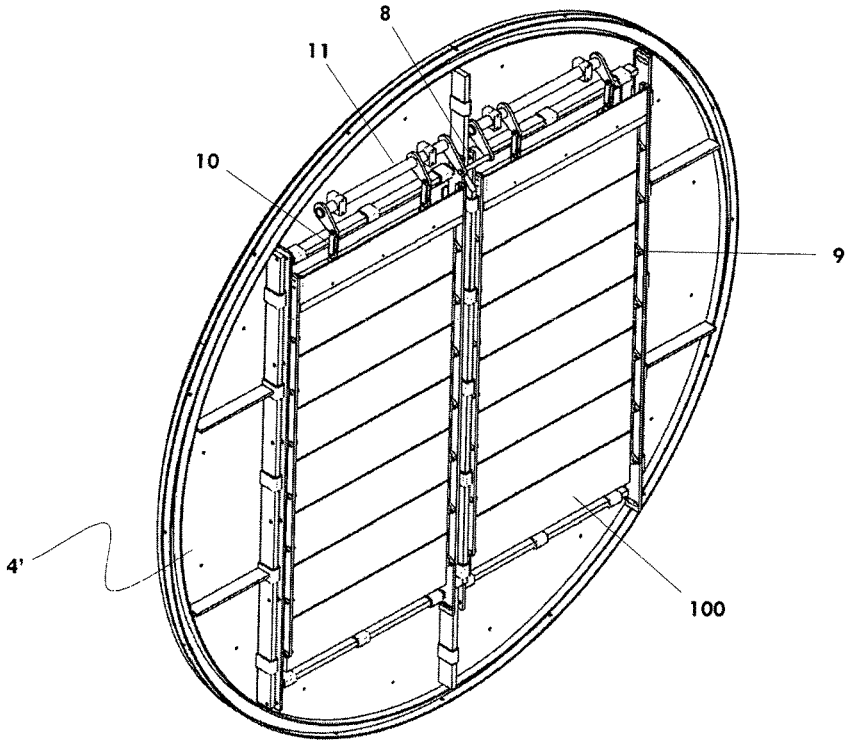
FIG. 4 shows an axonometric view of the rear surface of the thermal chamber, with screens in complete closing position, according to an embodiment of the present invention.
Figure 5:
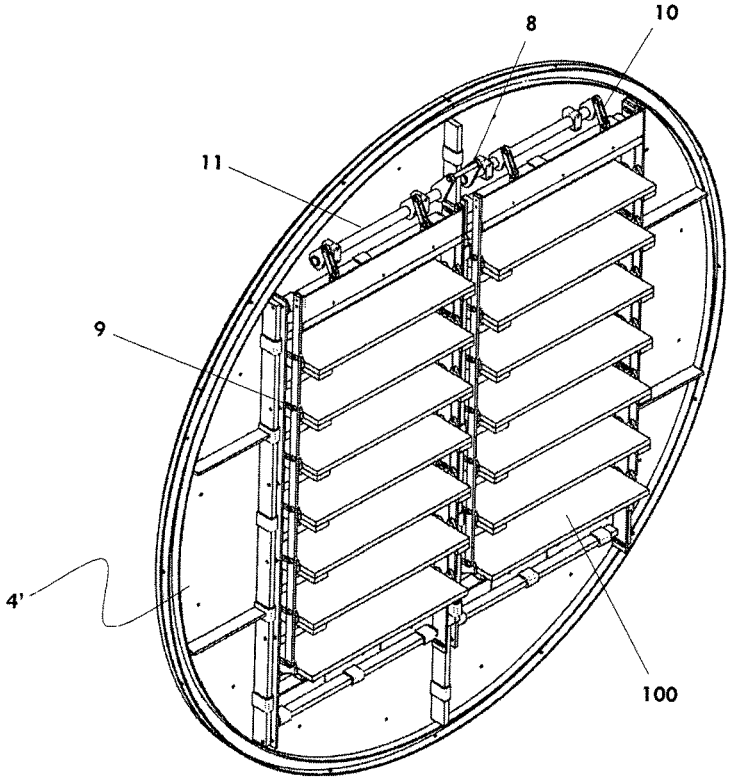
FIG. 5 shows an axonometric view of the rear surface of the thermal chamber, with screens in complete closing position, according to an embodiment of the present invention.
Figure 6:
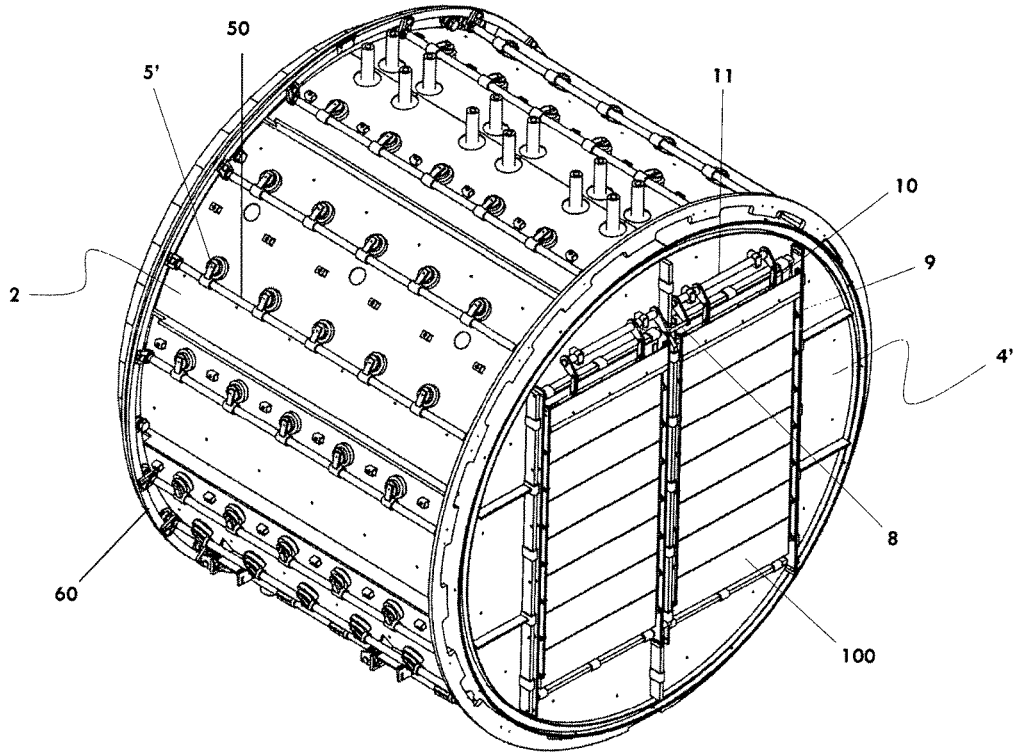
FIG. 6 shows an axonometric view of the thermal chamber, with screens in complete closing position, according to an embodiment of the present invention.
Figure 7:
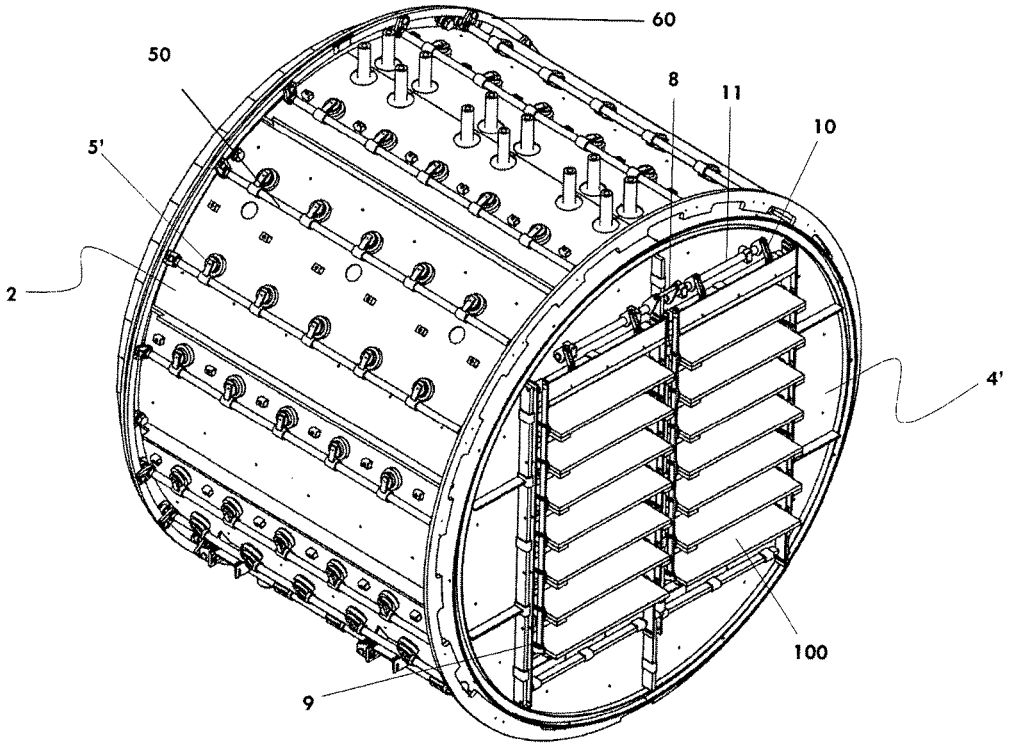
FIG. 7 shows an axonometric view of the thermal chamber, with screens in complete opening position, according to an embodiment of the present invention.
Figure 8:
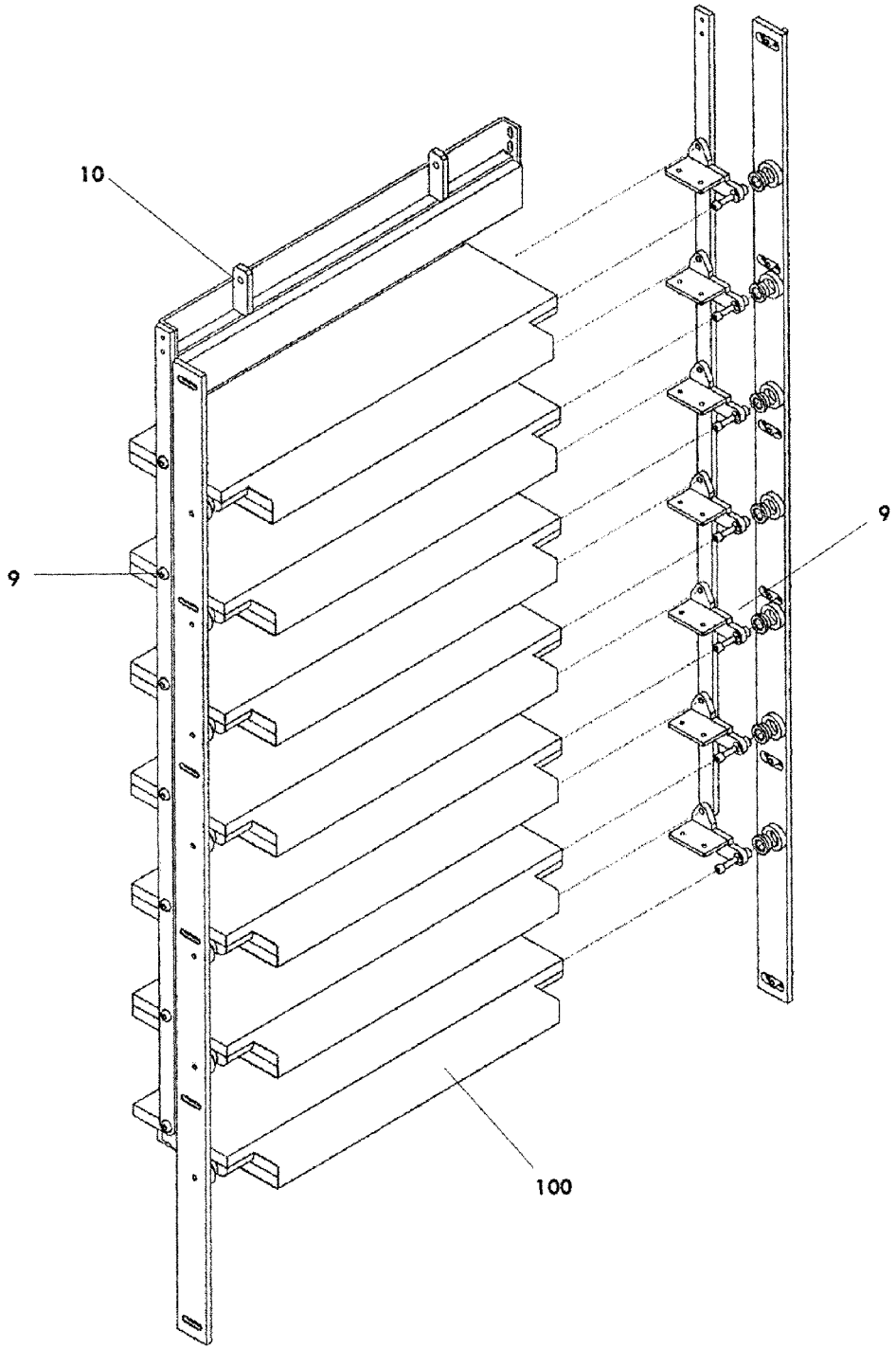
FIG. 8 shows an axonometric view of the screens in complete opening position, according to an embodiment of the present invention.
Figure 9:
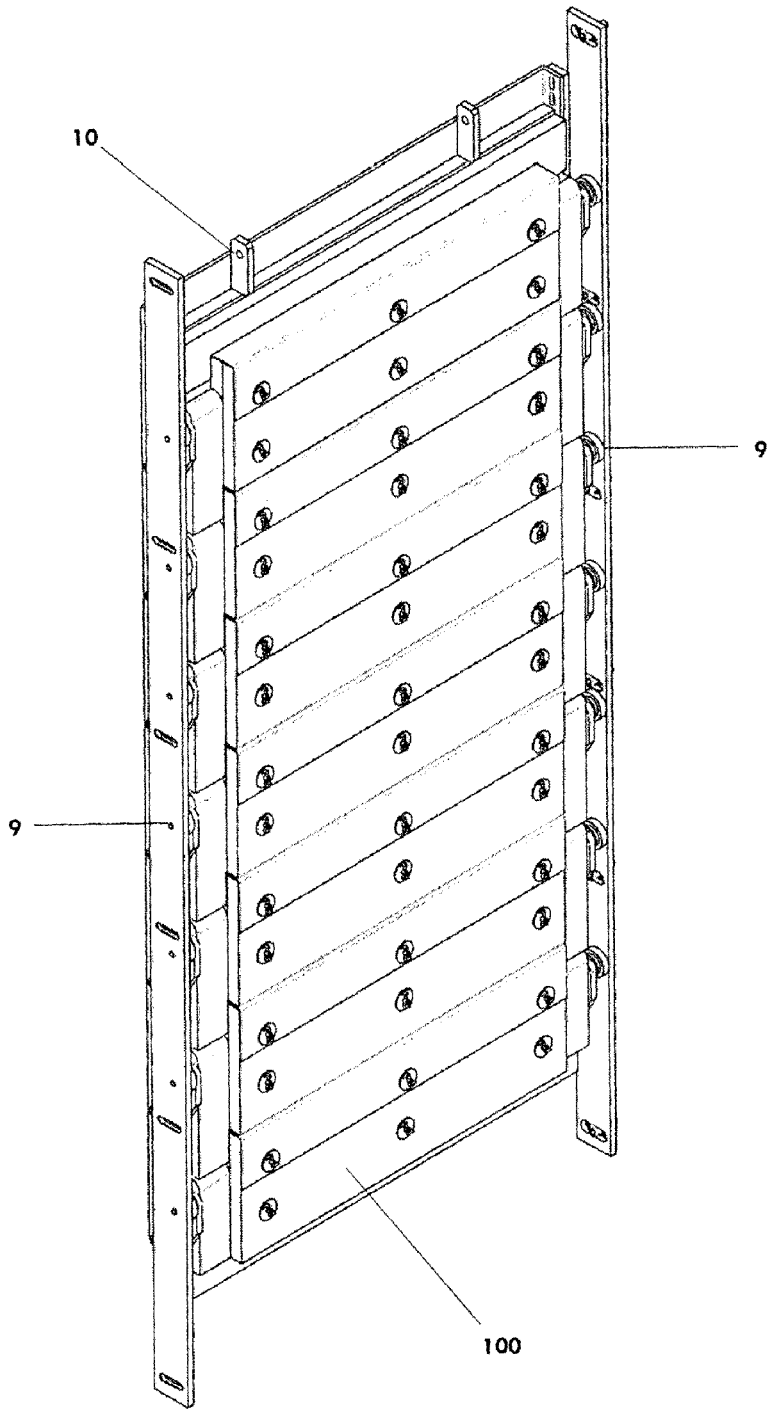
FIG. 9 shows an axonometric view of the screens in complete closing position, according to an embodiment of the present invention.
Figure 10:
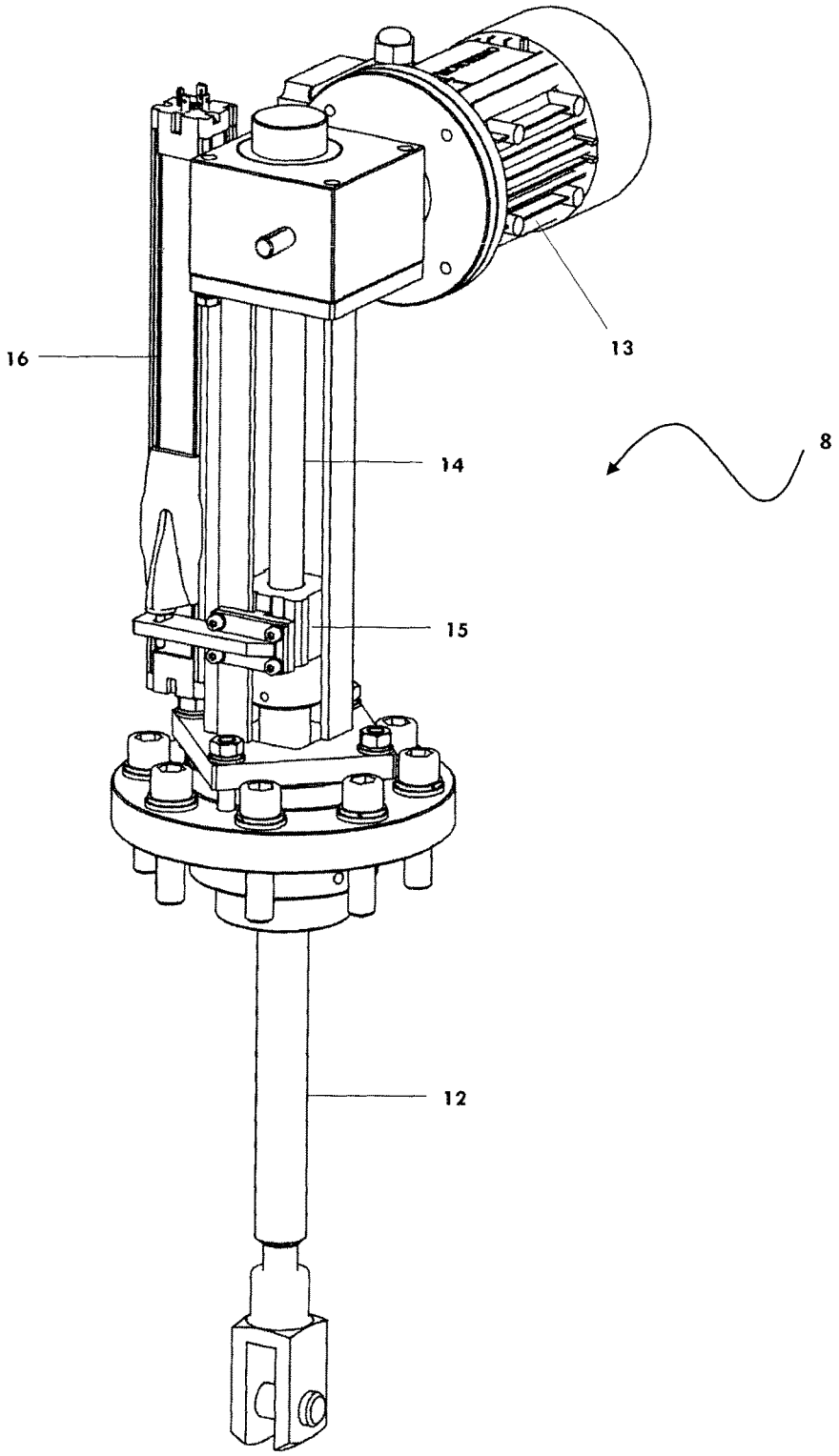
FIG. 10 shows an axonometric section of the movement system according to an embodiment of the present invention.

A first embodiment of the present invention is shown in FIGS. 2 and 3, in which the rear surface 4' of the thermal chamber 2, upwards of the heat exchanger 6 is provided with a plurality of screens 100, hinged both to the thermal chamber 2 and to a actuation system 8. The screens 100 are rotated by means of a system of levers 9, which act at the same time on all the apertures 100. Said levers 9 are controlled by a rod 10, connected to a suitably shaped crankshaft 11. The movement of the crankshaft 11 is carried out by a rod 12, integral to a bushing 15 sliding on a worm screw 14 coupled to the motor 13 (FIG. 10).

According to a first embodiment of the invention, the screens 100 divide the gas passage area. In this way, they can work with a movement in a range between 0° and 90°, wherein 0° corresponds to the position in which the screens 100 are parallel to the wall of the thermal chamber 2, where the gas passage is completely closed; while 90° corresponds to the position in which the screens 100 are perpendicular to the wall of the thermal chamber 2, where the passage gas is maximum.

Moreover, since the screens 100 are little dimensioned, these need a smaller range and allow a greater area of the thermal chamber 2 to be covered. As a consequence, the gas quantity which can cross them and so the gas quantity passing in the heat exchanger 6 on the whole surface available for thermal exchange increases, thus increasing also the yield of the same furnace 1.

Another embodiment of the present invention comprises also a control method of "precision speed control cooling" type (PSC), which allows an accurate regulation of the opening angle of the screens 100, thus allowing such a dissipation that the little temperature heads needed by the modern thermal treatments are respected.

Such method can be in fact applied in some treatments which need to carry out little temperature variations during the cooling steps and in well determined time intervals.

The temperature regulation during the cooling step, according to the desired cooling curve, is carried out as follows: the gases are first introduced from the circular apertures 5, then the temperature is regulated by controlling the gas flow (by acting on the speed of the rotor 90); in parallel a fine temperature regulation occurs, modulating further the gas flows through the angle opening of the screens 100.

The traditional solution provides screens 100 which can carry out only a movement of the type opened-closed without any possibility of regulation. This implies that yet the opening of the screens causes a very high heat dispersion, i.e. the temperature can go down strongly in a short interval time in comparison with the values needed by thermal treatments. The control method, object of the present invention allows an accurate regulation of the opening angle of the screens, thus allowing such a dissipation that the little temperature heads are respected.

Figure 11:
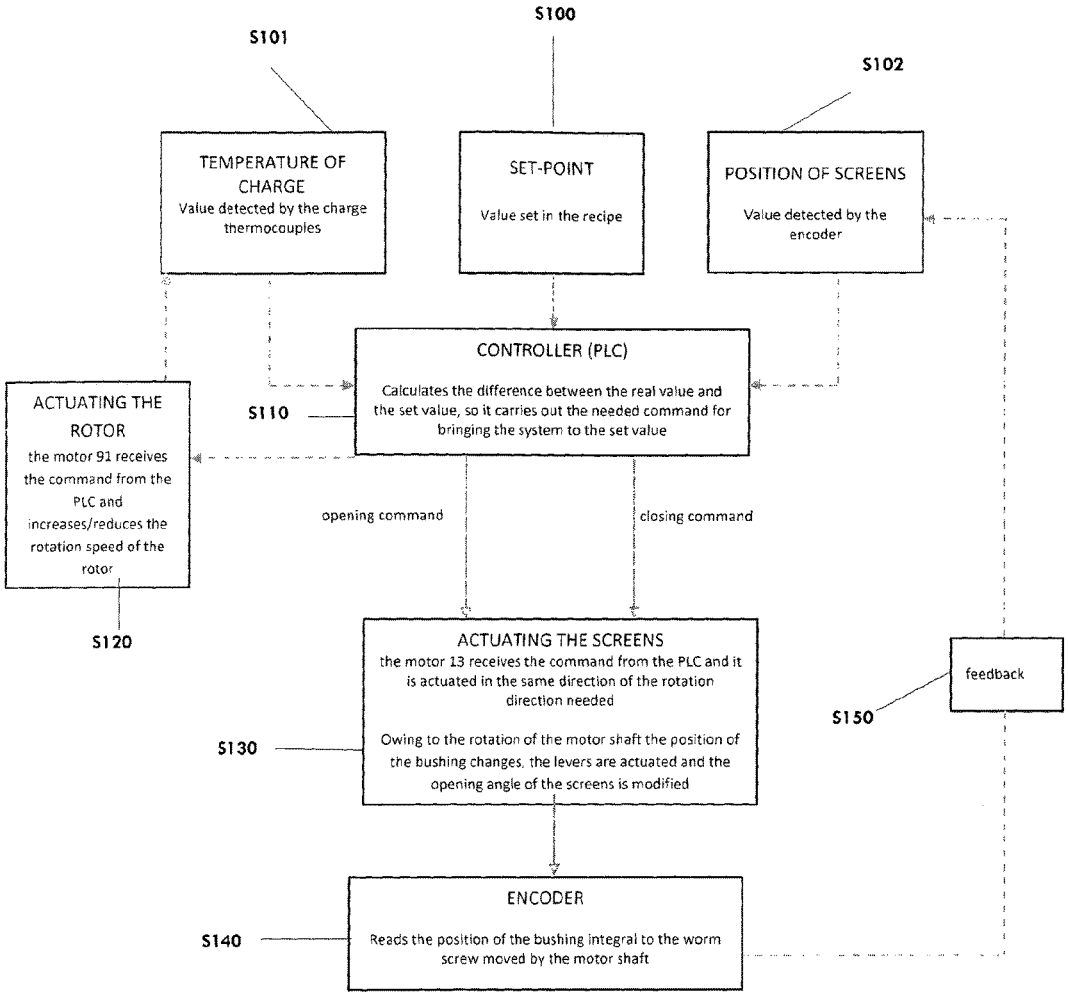
FIG. 11 shows a flowchart of the control system of the opening angle of the screens, according to an embodiment of the present invention.

The managing method, whose flowchart is shown in FIG. 11, comprises the following steps:

a. defining S100 the map of set points of the temperature of charge, measuring S101 the effective temperature of charge detected by the charge thermocouples and defining S102 the opening degree of the screens as detected by the encoder as input parameters of a controller (PLC).
b. calculating S110 the difference in temperature between the measured value and the set point value and carrying out the needed command (opening or closing of the screens) to bring the system to the set value;
c. receiving S120 the command from the controller (PLC), regulating the speed of the rotor 90 by means of the motor 91 and consequent gas flow variation;
d. receiving S130 the command from the controller (PLC), actuating the screens 100 by means of the actuation system 8 and variation of the opening angle of the screens;
e. reading S140 the degree of the screens opening by means of the encoder;
f. feedback S150 of the screens opening degree towards step b.

The managing method regulating the system object of the present invention allows to vary the rotation angle of the screens 100 according to the particular thermal treatment desired. The method is carried out (FIG. 10) by an encoder 16 which reads the position of the bushing 15 and transmits the signal to the controller (PLC), which compares the measured value with the set value, i.e. the set-point input in defining step of the thermal cycle by means of the software interface provided in the operating panel (in the machine or in the control switchboard). After such comparison, in order to bring the system back to the set value, it is sent a command, both of opening or closing of the screens 100, to the inverter, which actuates the motor 13 in the same direction of the rotation direction needed. The coupling between the motor 13 and the worm screw 14 makes the bushing 15 slide which causes a movement of the integral rod 8, which leads to the variation of the opening angle of the screens 100.

Moreover, the sliding of the bushing 15 modifies the position read by the encoder 16, which sends the datum to the controller (PLC) for recalculating a new command, thus creating a feedback cycle.

In addition to the embodiments of the invention, as above described, it is to be intended that there exist many other variants. Further, it is to be intended that the embodiments are only example and do not limit the scope of the invention and its possible application or configurations. On the contrary, even if the above description gives the experts in the filed the possibility to realize the present invention at least according to one example configuration thereof, it is to be intended that many variations of the elements described can be made without departing from the scope of the invention encompassed by the appended claims, literally interpreted and/or legal equivalents thereof.

The invention claimed is:

1. Furnace for thermal treatment with gaseous atmosphere quenching consisting of a bell inside which there is provided a rotor regulating the gas atmosphere flow, a heat exchanger regulating the temperature of the gas atmosphere and a thermal chamber configured for thermal treatment and the following gaseous atmosphere quenching, said thermal chamber consisting of a surface positioned on a side adjacent to the heat exchanger and a surface positioned on an opposed side to the surface adjacent to the heat exchanger and wherein a surface consists of a plurality of screens which connect the inside of the thermal chamber with the inside of the bell to allow the passage of the gas atmosphere from the thermal chamber to the bell, wherein said screens are adjustable to modify the passage section and so the flow of the gas atmosphere in function of the temperature required by the thermal treatment, and wherein said screens are hinged to said surface of the thermal chamber positioned on a side adjacent to the heat exchanger.

2. Furnace according to claim 1, wherein said screens have a movement in a range of between 0° and 90° , wherein 0° corresponds to the position in which the screens are parallel to the wall of the thermal chamber, where the passage of the gas is completely closed; and wherein 90° corresponds to the position in which the screens are perpendicular to the wall of the thermal chamber, where the passage of the gas is maximum.

3. Furnace according to claim 1, wherein said screens are connected to a actuation system.

4. Furnace according to claim 3, wherein said actuation system comprises a plurality of levers controlled by a rod connected to a crankshaft, which is constrained to a rod integral to a bushing sliding on a worm screw.

5. Method for controlling the temperature in an furnace for thermal treatment with gaseous atmosphere quenching according to claim 1, by means of regulating the rotation angle of screens of the furnace and having the following steps:

a) defining the map of the set points of the temperature of charge, measuring the effective temperature of charge detected by the charge thermocouples and defining the opening degree of the screens as detected by the encoder as input parameters of a controller (PLC);

b) calculating the difference in temperature between the measured value and the set point value and carrying out the needed command of opening or closing of the screens to bring the system to the set value;

c) receiving the command from the controller (PLC), regulating the speed of the rotor by means of the motor and consequent gas flow variation;

d) receiving the command from the controller (PLC), actuating the screens by means of the actuation system and variation of the opening angle of the screen;

e) reading the degree of the screens opening by means of the encoder; and f) feedback of the screens opening degree towards step b.

* * * * *